United States Patent [19]

Tuson

[11] 4,190,090

[45] Feb. 26, 1980

[54] EQUIPMENT SERVING TO CONNECT OIL-TANKERS TO MARINE TOWERS

[75] Inventor: Samuel Tuson, Mesnil-le-Roi, France

[73] Assignee: Entreprise d'Equipements Mecaniques et Hydrauliques E.M.H., France

[21] Appl. No.: 841,484

[22] Filed: Oct. 12, 1977

[30] Foreign Application Priority Data

Oct. 19, 1976 [FR] France ..... 76 31431

[51] Int. Cl.[2] ..... B63B 35/44; B67D 5/04

[52] U.S. Cl. ..... 141/387; 137/355.26; 137/615

[58] Field of Search ..... 137/355.16, 355.2, 355.23, 137/355.26, 615; 141/387, 388, 279, 284

[56] References Cited

U.S. PATENT DOCUMENTS

| | | | |
|---|---|---|---|
| B 367,640 | 1/1975 | Olson | 242/47.5 |
| 2,615,756 | 10/1952 | Granberg | 137/355.2 |
| 3,249,121 | 5/1966 | Bily | 141/388 |
| 3,654,951 | 4/1972 | Pogonowski et al. | 137/355.66 |
| 3,670,930 | 6/1972 | Irie et al. | 137/615 |
| 3,727,650 | 4/1973 | Ingraw et al. | 141/388 |
| 3,889,896 | 6/1975 | O'Hara | 137/355.23 |
| 3,913,157 | 10/1975 | Versluis et al. | 141/388 |
| 3,921,557 | 11/1975 | Kapteign et al. | 141/387 |
| 3,980,037 | 9/1976 | Tuson | 141/388 |

FOREIGN PATENT DOCUMENTS

| | | |
|---|---|---|
| 2230542 | 12/1974 | France . |
| 2260490 | 9/1975 | France . |
| 1125347 | 8/1968 | United Kingdom . |

*Primary Examiner*—Martin P. Schwadron
*Assistant Examiner*—A. Michael Chambers
*Attorney, Agent, or Firm*—Steinberg and Blake

[57] ABSTRACT

Apparatus for connecting a petroleum-oil supply line mounted on a marine column to a receiver conduit mounted on an oil-tanker, said column a head being mounted pivotally about the axis of said column at its upper end and including a rotary turret with a boom extending radially therefrom, wherein the improvement comprises a single-turn rotary pulley mounted on the head of the column and adapted to receive the upstream length of a hose-pipe, apparatus for permanently connecting the upstream end of said hose-pipe to the downstream end of the oil-supply line of said column, and apparatus for supporting and guiding the downstream length of the hose-pipe from the pulley to the end of said boom in such a manner that a connecting member provided at the downstream end of the downstream length has its outlet opening constantly directed downwards at the end of the said boom.

5 Claims, 9 Drawing Figures

Fig. 3.
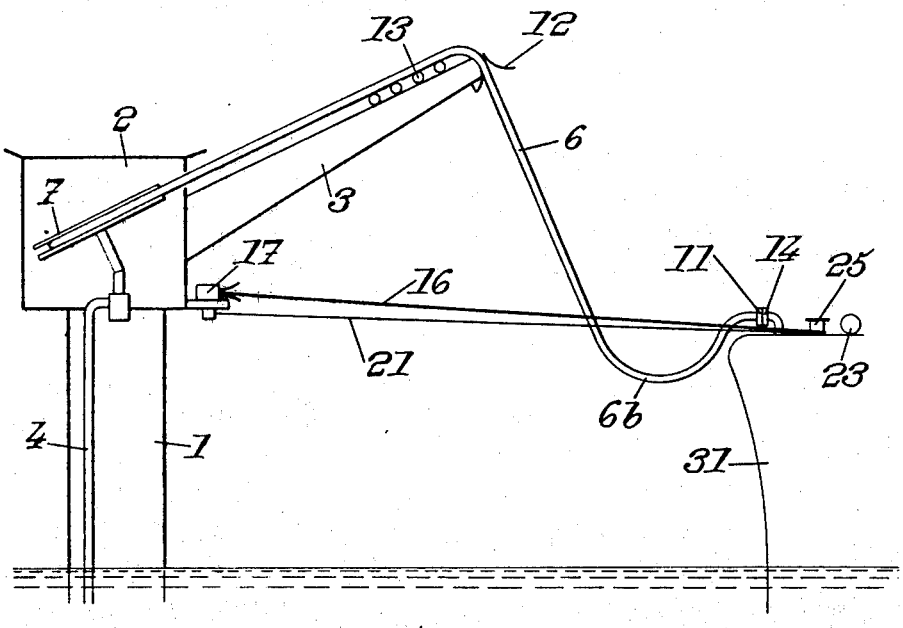
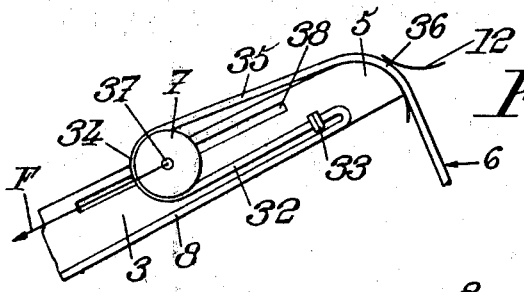
Fig. 9.
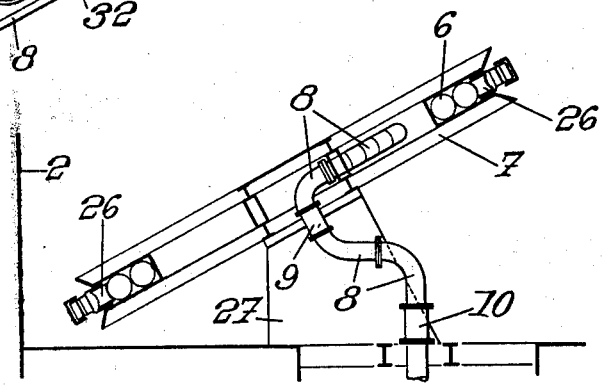
Fig. 4.

EQUIPMENT SERVING TO CONNECT OIL-TANKERS TO MARINE TOWERS

The present invention relates to equipment for connecting petroleum transport vessels or oil-tankers to towers or columns, or buoys, anchored to the sea bed or ocean floor, with or without possibility of horizontal oscillation, the said towers or columns comprising, on the one hand, oil or other hydrocarbon supply means, and, on the other hand, a head mounted pivotally about the axis of the tower and consisting of a rotary turret from which a boom extends, the purpose of the said connection providing, on the one hand, mooring of the vessel to the tower and, on the other hand, connection of an oil-supply conduit or line mounted on the tower to an oil-receiver conduit mounted on the vessel.

The invention relates more particularly to such equipment which employs for such connection a flexible pipe length which will be referred to hereinafter as a "hose-pipe".

In the known types of such equipment, the hose-pipe is generally permanently suspended from the end of the boom.

Although such prior art arrangements offer advantages, one disadvantage inherent therein arises from the fact that the hose-pipe is continually exposed to the elements and particularly to oscillations at the mercy of the wind even when they are not in service.

Now such a hose-pipe, the diameter of which reaches and even frequently exceeds 40 cm, as well as its connecting accessories, constitutes the weak element of the connecting equipment for it is subject to rapid deterioration under the action of weather conditions and must therefore be replaced rather frequently.

The present invention provides for such permanent exposure of the hose-pipe to the elements to be avoided.

The connecting equipment according to the invention comprises a rotary single-turn pulley mounted on the tower head and adapted to receive at least partially the upstream portion of the hose-pipe, means for permanently connecting the upstream end of this hose-pipe portion to the downstream end of the oil supply conduit of the tower; and means for supporting and guiding the downstream portion of the hose-pipe from the pulley to the end of the boom in such a manner that a connecting member provided on the downstream end of this portion has its outlet opening constantly directed downward at the end of the said boom.

In preferred forms of embodiments use is also made of one and/or other of the following features:

(a) the equipment comprises means for constantly and resiliently urging the pulley in a direction tending to move the hose-pipe into the head, (b) the pulley axis is stationary and vertical, (c) in equipment according to the foregoing paragraph, the pulley is integral with a rotary platform mounted on the top of the tower head and mounted rotatably about a vertical axis with respect to the head, (d) the axis of the pulley is stationary and slightly inclined to the vertical and the connection between the upstream end of the hose-pipe wound on the pulley and the oil supply conduit of the tower is provided through two rotary joints having as their axes that of the pulley and that of the head, respectively, which in this case are distinct from one another, (e) the pulley, the axis of which is stationary, is divided into two coaxial elementary pulleys mounted rotatably in opposite directions to one another and each adapted to receive an elementary hose-pipe of reduced diameter, both elementary hose-pipes being connected at their downstream ends to a common connecting element, (f) the pulley, used as a mule or intermediate guiding pulley, is so mounted on the boom that its axis is movable transversely in a guide extending the length of the boom and (g) the connecting equipment considered further comprises a hawser normally stored or wound up on the tower, and the downstream end of which is attached to the downstream end of the hose-pipe and includes an eye or loop at the point of attachment, and a rope or the like passing through the said eye and the upstream end of which is would on an actuating drum mounted on the tower, whereas its downstream end is connected to a locating float, the said rope comprising, at a distance from the float greater than the maximum distance selected for the beginning of the mooring manoeuvres of the vessel, a cross-bar or block too bulky to pass through the eye.

Apart from the above main arrangements, the invention also comprises other arrangements which are used preferably at the same time and will be referred to more explicitly in the following.

Preferred forms of embodiment of the invention will be described in the following with reference to the appended drawings which, of course, are non-limitative:

FIGS. 1, 2 and 3 are diagrammatic elevational views illustrating, at three successive instants of the operation, respectively, a connecting equipment between a vessel and a tower, according to the invention;

FIG. 4 is a more detailed view of a portion of the equipment;

FIG. 9 is a diagrammatic partial elevational view showing still another modification of a connecting element according to the invention.

Figure 1:
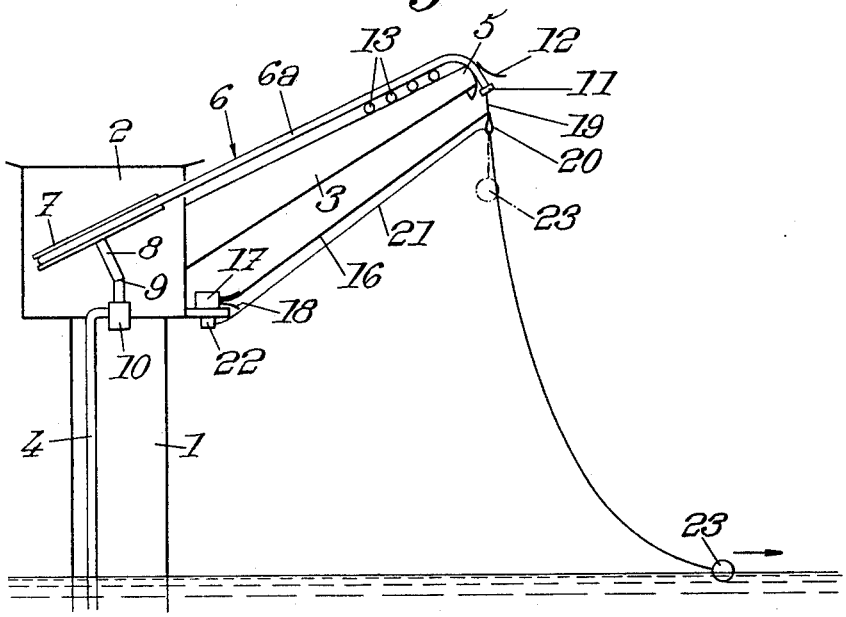
Figure 2:
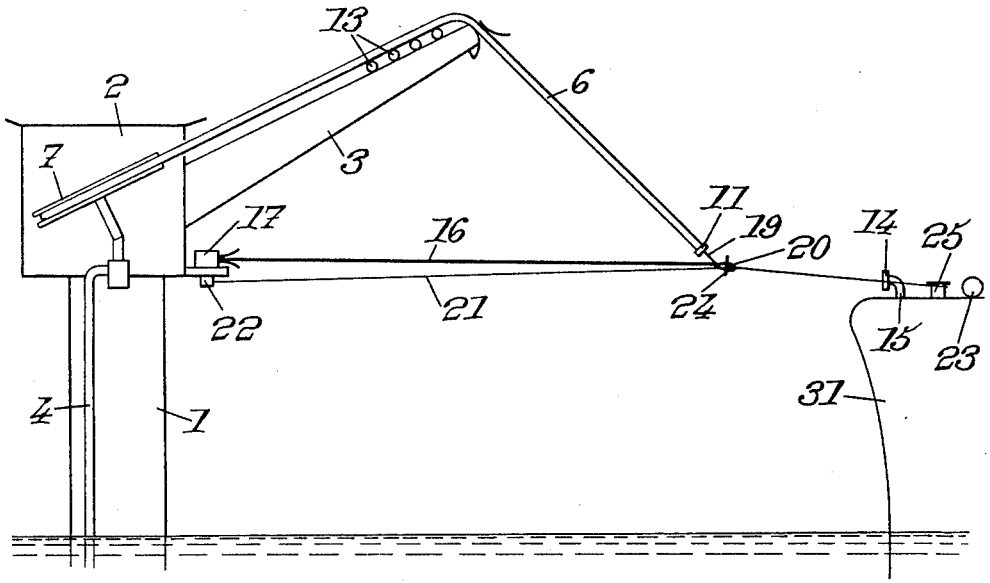

The tower or column 1 has its bottom (not shown) anchored to the sea bed or ocean floor through the medium, particularly, of a universal or a Cardan joint. A a rotary head 2 consisting of a turret or the like is rotatably mounted in the top end of the tower about the axis of the tower and from which a boom 3 extends radially, the boom being either horizontal or inclined to the horizontal at an angle generally smaller than 45 deg.

The free rotating motions of the turret and the associated boom about the vertical axis of the tower are produced automatically by the forces exerted thereon by the moored vessels, the latter thus being themselves allowed to float freely at the mercy of the wind and the sea streams.

The tower is equipped with an oil supply conduit or line 4 which, in conventional structures improved by the invention, is connected to a distributing end-piece located at the end 5 of the boom 3.

This is the end-piece which is connected to the oil-tankers for the purpose of loading the latter with oil.

This connection is ensured by a hose-pipe 6 provided at its downstream end with a connecting element 11, but instead of being permanently suspended from the boom end 5 as in the prior art, the hose-pipe according to the invention is so designed that, on the one hand, it is normally stored on the head 2 by being wound partially round a single-turn rotary pulley 7, with the outlet of the hose-pipe end element 11 at the end 5 of the boom opening downwards within a guiding shelter 12, and on the other hand, it can be easily paid out from the end of the boom to the vessel to be loaded, but only during the loading periods.

By "single-turn" pulley is understood a pulley the bottom of the groove of which is circular or spiral, but not helical, the width of the said groove along the axis of the pulley being adapted to receive a single hose-pipe length or portion, thereby allowing the hose-pipe to be wound on the said pulley in either a single turn or several radially superposed turns instead of several turns arranged side by side, as for example on a drum. Indeed the use of a drum is excluded in the case considered, owing to the guiding difficulties and the torsional stresses which would ensue.

The upstream end of the hose-pipe 6 is permanently connected to the conduit 4 through rigid connecting pipes 8 and at least one rotary joint 9,10.

In the first forms of embodiment which will now be described with reference to FIGS. 1 to 8, the axis of pulley 7 is stationary and the hose-pipe length 6*a* defined between the pulley 7 and the shelter 12 is supported and over the entire length of the boom 3 by any suitable means for example as a roller raceway 13, or a chute or trough lined with a smooth wear-resistant coating, or a conveyor band. This support is advantageously protected from rough weather conditions by a suitable screen (not shown), particularly a tunnel-shaped screen.

A motor is provided for the rotation of the pulley in one or other of its two directions so as to either pay out or rewind the hose-pipe 6, through the medium of an appropriate gear train.

Means are furthermore provided to angularly and resiliently urge the pulley 7 in the direction of winding of the hose-pipe thereon, which means may be of any suitable nature, e.g. mechanical, hydraulic and/or pneumatic.

In the first form of embodiment illustrated in FIGS. 1 to 4, the axis of pulley 7 is inclined to the vertical, thereby allowing the core of the pulley to be arranged in prolongation of, i.e., in alignment with a boom 3 inclined to the horizontal.

The upward inclination of the boom offers the advantage of allowing its end shelter 12 to be located in a relatively high position with respect to the level of the sea despite a relatively small total height of the tower 1. As an illustration, it is frequently necessary for the end 5 of the boom 3 to be located at a height of more than 30 m, so as to overhang the vessel prows or bows which themselves extend more than 20 m over the water line of such vessels in the light or unloaded state.

This inclination of the pulley axis requires, in order to ensure a fluid-tight connection between the wound up hose-pipe 6 and the conduit 4, two successive rotary joints 9 and 10, the axes of which correspond to those of the pulley 7 and of the tower 1, respectively, as well as several intermediate rigid elbows 8 as seen clearly in FIG. 4.

The connection between an oil-tanker 31 (FIGS. 2 and 3) and the tower 1 includes:

(a) a fluid-tight connection between the connecting element 11 and a complementary connecting element 14 fixedly mounted on the vessel at the upstream end of the oil-receiver conduit 15 of the vessel, and (b) the mooring of the vessel to the tower by means of a hawser 16.

Described below is a preferred but non-limitative form of embodiment of the means used for carrying out these operating steps, which means may be used whatever the type of pulley employed.

The hawser 16 is normally stored on the tower, i.e. wound on a drum 17 carried by the head 2 as illustrated, or kept in tension within the tower by means of a balance- or counter-weight according to the teachings of French Pat. No. 74 04 643 of Feb. 12, 1974.

The free end of the hawser issues from the head 2 through a guiding trumpet or like flared tube 18 and is attached to the connecting element 11 or, more precisely, to a chain 19 itself hooked to this element and having an eye 20 defined at its end.

A rope 21 or the like passing through the eye 20 is wound at one end on a drum 22 of the head 2 and is connected at its other end to a float 23. At a predetermined distance from the float, depending upon the maximum distance between tower and vessel selected for the beginning of the mooring operations (e.g. at a distance corresponding to a 15 m-approach of the vessel prow with respect to a point plumb with the end of the boom 3) the rope is provided with a cross-bar or block 24 too big or bulky to pass through the eye 20.

The mooring steps may be carried out as follows, assuming them to be completely remote-controlled from the vessel (the assistance of a crew on the tower may also be contemplated, in which case the procedure can be easily inferred from the following description by replacing the various remote-control means by local ones).

Initially the hose-pipe 6, the hawser 16 and the rope 21 are stored on the tower in their fully wound positions (FIG. 1) and the float 23 is suspended from the eye 20. In particular the hose-pipe 6 is protected from the natural weathering agencies and from the swaying motions which would tend to damage it.

When the vessel 31 is within operating range, i.e. proximately situated, with respect to the tower, in the direction where the wind and streams would tend to freely drive it off after the mooring, the drum 22 is remotely operated from the vessel so as to pay out the rope 21 and lower the float 23.

When the latter reaches the level of the sea, the streams and the wind displace it towards the vessel while the rope continues to be paid out by the drum 22.

This displacement may be assisted by remote control of a small thruster or propeller connected to the float.

When the float reaches a point in proximity to the vessel, it is picked up by means of a grabnel or the like and hoisted on board the vessel.

The float is then detached from the rope 21 and the latter is pulled towards the vessel. As soon as the cross-bar 24 reaches the eye 20, this pull is accompanied by a parallel pull on the hose-pipe 6 and the hawser 16 (FIG. 2), the said pull being synchronized with the remote-controlled pay-out rotations of the pulley 7 and the drum 17.

When the ends of the hose-pipe 6 and of the hawser 16 reach the vessel they are detached from one another, whereupon the hawser is stowed on a drum 25 arranged on the deck of the vessel and the connecting member 11 at the end of the hose-pipe 6 is sealingly assembled to the member 14 thereby ensuring the desired connection (FIG. 3) and allowing the vessel to be loaded with oil.

Before effecting this last connection, it is advantageous to ensure that a loop 6b is formed at the base of the "aerial" length of the hose-pipe 6, that portion of its length located between the shelter 12 of the boom and the connecting member 14 of the vessel. The presence of this loop assists the resilient return of the pulley in flexibly absorbing the relative vertical motion of the vessel and of the tower during the loading of the vessel with oil, i.e. both the heave and the progressive sinking of the vessel.

In order to form such a loop the hose-pipe has merely to be paid out and/or the vessel has to be sufficiently moved closer to the tower by exerting the necessary tension on the hawser.

When the loading is over the reverse operations are performed to restore the initial situation, the said reverse operations including particularly the separation of the connected elements 11 and 14, the mutual re-hooking of the previously unhooked members (float 23 and downstream ends of flexible members 6 and 16), and remote control ensuring the rewinding onto the pulley 7 and and drums 17 and 22.

The pulley 7 must be large in diameter so that a sufficient length of the hose-pipe 6 can be wound thereon and, additionally, so that the curvature of the wound hose-pipe is not excessive. Diameters of the order of 10 m and even more may be contemplated for such a single-turn pulley as defined above.

The advantage of the utilization of a single-turn pulley is that it eliminates the drawbacks of the superposed hose lengths (namely, risk of local deterioration of the hose-portions squeezed by the connecting flanges of the adjacent portions).

In certain cases, however, the hose-pipe 6 may be wound in several radially superposed turns, as in the form of embodiment illustrated in FIG. 4.

Also seen in FIG. 4 are:

(a) passing rollers 26 arranged at the periphery of the pulley so as to apply a radial pressure in a direction towards the axis the hose-pipe 6 wound thereon, thereby ensuring a good winding of the hose, and (b) a body 27 accommodated in the tower head 2 and supporting the pulley through the medium of an annular bearing (not shown).

In the three specific embodiments diagrammatized in FIGS. 5 to 8 which will now be described, the elements similar to those described previously are designated by the same reference numerals as the latter, respectively.

These three specific embodiments differ essentially from the form of embodiment illustrated in FIGS. 1 to 4 in that the axis of the pulley 7 receiving the hose-pipe is vertical instead of inclined to the vertical.

In each case the core of the pulley extends in prolongation of the boom 3, which therefore extends horizontally.

Although a horizontal extension of the boom requires, for a given height of the end 5 of the boom, a greater height for the tower 1, it simplifies the connections between the hose-pipe wound on the pulley and the supply conduit 4, such a connection generally requiring a single rotary joint 10. Moreover, it makes a horizontal surface available for storing and supporting the hose-pipe between the pulley and the end of the boom, thereby simplifying in situ maintenance and, if necessary, replacement of the various lengths constituting the hose-pipe.

Figure 5:
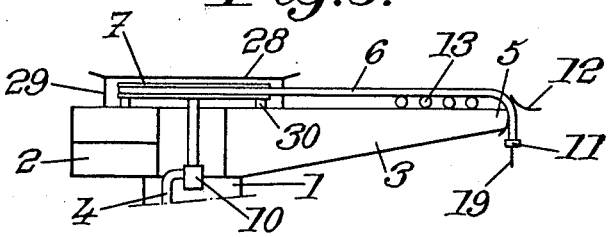
FIGS. 5, 6 and 8 are views similar to FIG. 1, illustrating three modifications of such equipment according to the invention.

In the embodiment of FIG. 5, the pulley 7 is placed right below a helicopter landing platform or helipad 28 surmounting the head 2. The pulley is accommodated in a chamber defined externally by a wall 28 ensuring reliable protection of the pulley and the hose-pipe wound thereon against the natural weathering agents.

The periphery of the hose-pipe 7 rests, independently of the platform 28, upon a rolling raceway 30 carried by the head 2.

Figure 6:
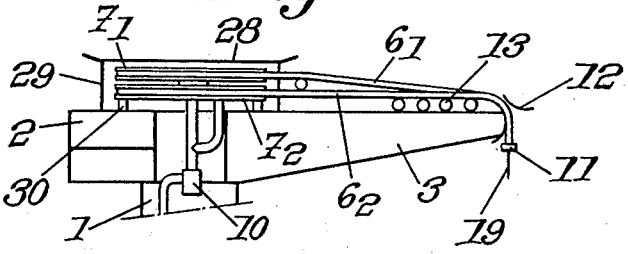
Figure 7:
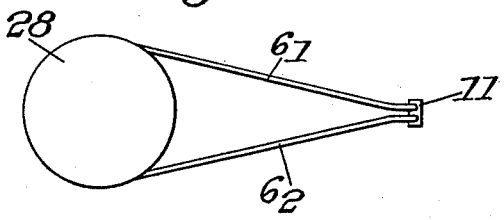
FIG. 7 is a diagrammatic top view of a portion of the equipment shown in FIG. 6.
Figure 8:
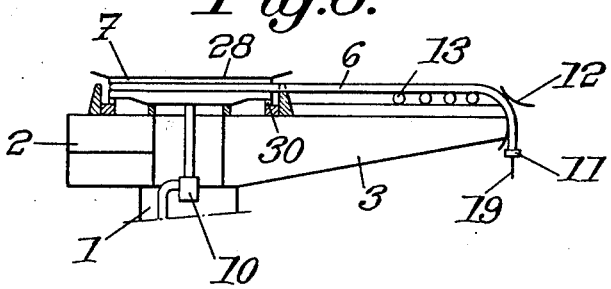

The embodiment illustrated in FIGS. 6 and 7 differs from that of FIG. 5 in that the hose-pipe 6 is divided into two elementary hose-pipes $6_1$ and $6_2$, each with an inner cross-sectional area half as large as that of the foregoing hose-pipe 6. The said elementary hoses are wound in mutually opposite directions on two superposed coaxial elementary pulleys $7_1$ and $7_2$, respectively, so mounted as to be rotated in the same manner but in mutually opposite directions about their axis.

Both elementary hose-pipes $6_1$ and $6_2$ have their downstream ends connected to a common connection member 11 so arranged as to co-operate in the same manner as the foregoing ones with the complementary connecting member 14 provided on the vessel.

As for the upstream ends of hose pipes $6_1$ and $6_2$, they are both connected by appropriate rigid tubular sections to the same rotary joint 10.

Such a division of the hose-pipe into two hoses allows the diameter used for the latter to be substantially reduced. Thus, for a given flow rate, a single hose-pipe with an inner diameter of 40 cm can be replaced by two elementary hose-pipes with an inner diameter of only 28 cm.

In the embodiment of FIG. 8, the pulley 7 is again arranged right below a landing platform 28, but in this case the pulley is integral with the latter and therefore rotates together therewith with respect to the head 2. In particular, the said pulley may be simply constituted by a groove provided on the external surface of a cylindrical wall supporting the said platform.

In the latter case, helicopter landings on and take-offs from the platform 28 should of course be avoided during the winding or unwinding of the hose-pipe 6.

According to a modification which is not illustrated in the drawings, use can be made of both a pulley with a vertical axis and a boom inclined to the horizontal so as to combine the respective advantages of both arrangements, i.e. simplicity of upstream connection of the hose pipes and relatively great height of the boom end, by bending the hose-pipe between its exit from the pulley downstream and the guiding path of the hose-pipe along the boom, by means of appropriate devices such as a roller system or a chute provided with a sliding coating.

According to still another specific embodiment diagrammatized in FIG. 9, the pulley 7 is not actually used for winding the hose-pipe thereon but as an idler, mule or intermediate pulley.

In this case the hose-pipe is in the form of a series of integrally connected lengths extending in prolongation of one another, namely:

an upstream rectilinear length 32, extending the length of the boom 3 and connected at its upstream end 33 closest to the end 5 of the boom to the downstream end of a rigid pipe 8 connected as previously to the conduit 4 of the tower, a length 34 passing around the pulley 7 and forming an arc of the order of 180 deg, a rectilinear length 35 which may be parallel to the length 32 and connects the pulley to the end 5 of the boom, and a bent length 36 passing through the shelter 12 so as to slide along the internal surface of the latter.

The length 36 is the end length of the hose-pipe, itself provided at its end with the connecting element 11, when the said hose-pipe is in its stored state.

The shaft 37 of the pulley 7 is so mounted as to be transversely movable, under the action of appropriate means, along a guiding path 38 carried by the boom 3 and extending along the latter.

The said moving action in the direction of arrow F is preferably a resilient one so as to allow, as previously, the relative displacements between the tower and the vessel to the resiliently or flexibly absorbed when the latter is connected to the former.

The shaft 37 may be horizontal as shown, but it is preferably vertical or slightly inclined to the vertical, i.e. perpendicular to the greater dimension of the boom, thereby allowing the two rectilinear hose-pipe lengths 33 and 35 to be more securely supported (by rollers, a sliding surface, a conveyor band or the like).

In all cases the pulley and the paths of the hose-pipe along the boom are protected from the natural weathering agents by any suitable screening and roofing means.

Consequently and whatever the form of embodiment opted for, the present invention provided vessel-to-tower connecting equipment, the structure, use and advantages of which, particularly the advantage of avoiding permanent exposure of a connecting hose-pipe to weathering agents, can be sufficiently inferred from the foregoing.

Of course, the invention is by no means limited to those applications and embodiments and which have been more particularly disclosed. On the contrary, it includes all modifications, particularly those in which the equipment disclosed may be used for purposes other than the loading of a vessel with hydrocarbons from a marine tower or column, for example the supply of the said tower or column from the said vessel with sea water, for ballasting or cleaning purposes, or for purposes of vessel unloading, the equipment carried by the tower in the embodiments disclosed above being then carried by a wharf or quay crane. Equipment of the kind disclosed above, but comprising hose-pipes smaller in diameter, can also be used to supply a marine tower or column from a vessel with a consumable liquid such as soft water or fuel oil.

Of course, the invention is by no means limited to the forms of embodiment described and illustrated which have been given by way of example only. In particular, it comprises all the means constituting technical equivalents to the means described as well as their combinations should the latter be carried out according to its gist and used within the scope of the following claims.

What is claimed is:

1. Apparatus for connecting a petroleum-oil supply line mounted on a marine column to a received conduit mounted on an oil-tanker, comprising: a rotary head mounted on said column and rotatable about the axis thereof; a boom mounted on said head and extending radially therefrom; a hose-pipe connected at its upstream end to said oil-supply line of said column; a connector member provided at the downstream end of said hose-pipe adapted to be coupled to said receiver conduit on said oil tanker; a mooring hawser connected at one end to storage means provided on said head and adapted to be connected at its other end to said oil-tanker to be loaded; and a hose-pipe storage pulley rotatably mounted on said head for receiving and storing a predetermined length of said hose-pipe, said hose-pipe being in its stored condition wound around said pulley and supported by said boom with only substantially said connector member extending from the free end of said boom, said boom including low friction hose-pipe guide means for guiding and supporting said hose-pipe, said pulley having a single circumferential hose receiving groove the width of which corresponds substantially to the diameter of said hose-pipe, and said pulley having a diameter adapted for storing in said single circumferential groove a length of said hose-pipe corresponding to the length of the hose-pipe in its working condition between said free end of said boom and the inlet of said receiver conduit.

2. Apparatus according to claim 1, further comprising means for constantly and resiliently urging said pulley in a direction tending to move said hose-pipe into said column head.

3. An equipment according to claim 1, wherein said boom is inclined with respect to the sea level so that the free end thereof is higher relative to sea level than the end thereof which is connected to said head, the axis of said pulley being stationary and extending substantially perpendicularly to at least the axis of the end of said boom connected to said head and the connection between the upstream end of said hose-pipe wound on said pulley and said oil-supply line of said column is provided, successively, by two rotary joints the axes of which correspond respectively to that of said pulley and to that of said column head.

4. Apparatus for connecting a petroleum-oil supply line mounted on a marine column to a receiver conduit mounted on an oil-tanker, comprising: a rotary head mounted on said column and rotatable about the axis thereof; a boom mounted on said head and extending radially therefrom; a flexible hose-pipe connected at its upstream end to said oil-supply line of said column; a connector member being provided at the downstream end of said hose-pipe adapted to be coupled to said receiver conduit on said oil-tanker, a mooring hawser connected at one end to storage means provided on said head and adapted to be connected at its other end to said oil-tanker to be loaded; and a hose-pipe storage pulley rotatably mounted on said head for receiving and storing a predetermined length of said hose-pipe, said hose-pipe being in its stored condition partially wound around said pulley and extending along said boom and supported thereby so that only said connector member extends from the free end of said boom, said boom including low friction hose-pipe guide means for guiding and supporting said hose-pipe, said hose-pipe storage pulley having a single circumferential hose receiving groove having a groove width corresponding substantially to the diameter of said hose-pipe, and said pulley having a diameter adapted for storing in said single circumferential groove a length of said hose-pipe corresponding to the length of said hose-pipe in its working condition between said free end of said boom and the inlet of said receiver conduit, the downstream end of said hawser being attached to the downstream end of said hose-pipe and being provided with an eye at its point of attachment to the latter, and a rope being provided one end of which is wound on an actuating drum provided on said head, said rope being adapted to pass through said eye and carrying at its other end and a locating float, said rope being provided at a portion thereof between said drum and said eye, at a distance from said float corresponding to the maximum distance selected for the beginning of the tanker mooring operations, said rope having a cross-bar having a dimension sufficiently large to engage said eye, said float being adapted to bring said hose-pipe and said hawser to said tanker.

5. Apparatus according to claim 4, wherein said drum is remotely operable from said tanker to be moored to move said float between a position wherein it floats on the sea level and a position where it is held in the proximity of said eye, suspended therefrom.

* * * * *